US010676164B2

(12) United States Patent
Carlési

(10) Patent No.: US 10,676,164 B2
(45) Date of Patent: Jun. 9, 2020

(54) MARINE APPARATUS FOR COLLECTING WASTE

(71) Applicant: IADYS, Aubagne (FR)

(72) Inventor: Nicolas Carlési, Aubagne (FR)

(73) Assignee: IADYS, Roquefort-la-Bedoule (FR)

( * ) Notice: Subject to any disclaimer, the term of this patent is extended or adjusted under 35 U.S.C. 154(b) by 0 days.

(21) Appl. No.: 16/132,066

(22) Filed: Sep. 14, 2018

(65) Prior Publication Data

US 2020/0086955 A1 Mar. 19, 2020

(51) Int. Cl.

| | |
|---|---|
| ***B63B 35/32*** | (2006.01) |
| ***E02B 15/04*** | (2006.01) |
| ***E02B 15/10*** | (2006.01) |
| ***B63H 5/14*** | (2006.01) |

(52) U.S. Cl.

CPC ..... *B63B 35/32* (2013.01); *B63H 5/14* (2013.01); *E02B 15/045* (2013.01); *E02B 15/046* (2013.01); *E02B 15/101* (2013.01)

(58) Field of Classification Search

CPC ..... B63B 35/32; E02B 15/046; E02B 15/045; E02B 15/101; B63H 5/14

See application file for complete search history.

(56) References Cited

U.S. PATENT DOCUMENTS

| | | | | |
|---|---|---|---|---|
| 3,931,740 A * | 1/1976 | Carter | G01N 1/10 | 73/863.23 |
| 5,022,987 A * | 6/1991 | Wells | E02B 15/046 | 210/173 |
| 5,102,540 A * | 4/1992 | Conradi | E02B 15/046 | 210/232 |
| 6,074,553 A * | 6/2000 | Haski | E04H 4/1263 | 210/167.2 |
| 7,101,475 B1 * | 9/2006 | Maaske | E04H 4/1263 | 210/106 |
| 7,677,268 B2 * | 3/2010 | Griffin | E04H 4/1654 | 137/624.14 |
| 2017/0022728 A1 * | 1/2017 | Simik | G05D 1/0206 | |
| 2018/0030645 A1 * | 2/2018 | Kulkarni | D06F 58/22 | |

OTHER PUBLICATIONS

Wasteshark, Plastic Waste Solutions, pp. 1-3, <https://www.ranmarine.io/aquadrone-wasteshark>.

"Waste and oil spill recovery vessels, outside harbours area—CATAGLOP : CG 92", ECOCEANE, pp. 1-3, <https://www.industry-plaza.com/waste-and-oil-spill-recovery-vessels-ou-p105424.html>.

Silvia Mondello, "Grove Boats Mini E-Cleaner, an unmanned debris recovery catamaran", Nautech News, pp. 1, <http://www.nautechnews.it/2016/01/19/grove-boats-mini-e-cleaner-an-unmanned-debris-recovery-catamaran/>.

* cited by examiner

*Primary Examiner* — Anthony D Wiest

(74) *Attorney, Agent, or Firm* — Buchanan Ingersoll & Rooney PC

(57) ABSTRACT

A marine apparatus for collecting waste, including a vessel frame; at least one float or ballast tank mounted on the vessel frame; a removable frame configured to receive a waste collector; at least one guide mounted on either the vessel frame or the removable frame; and at least one slide mounted on the other of the vessel frame or the removable frame, said at least one slide including a channel closed at one end and open at an opposite end, the open end forming a receiving end for receiving a respective guide.

15 Claims, 7 Drawing Sheets

MARINE APPARATUS FOR COLLECTING WASTE

TECHNICAL FIELD

The present application relates to an apparatus to collect materials such as waste, organic materials and objects inadvertently lost on or near the surface of water, in particular, a floating marine vessel for collecting such waste.

BACKGROUND OF THE INVENTION

Waste, such as plastic bottles, plastic bags and other detritus, and even hydrocarbons such as leaked oil are increasingly present in the world's water bodies. There are different ways to collect floating waste in harbors, water reservoirs (lakes, ponds), rivers (rivers, canals) and coastal areas.

There are manual solutions where workers maneuver motorized boats, collect the waste with a dip net and store them in bins. For hydrocarbons, floating dams can be used to contain pollution. Absorbent fabrics can be used to absorb the hydrocarbon or oil waste. These materials are then collected and treated. Dispersants can also be used to reduce an oil slick to fine particles that disperse in water. A vacuum head, weir skimmer or brush skimmer can also be used to collect oil spills.

Mechanized solutions include vehicles specifically designed to perform clean-up operations. These vehicles, maneuvered by on-board human operators, are able to collect floating wastes by a grid bucket and to collect the hydrocarbons by separating them from the water. Since at least 2016, a method taking a form of a submerged suction bin immersed in water that sucks all types of floating waste has been in use.

The submerged suction bin solution has the advantage of being able to operate continuously without the need for a human operator at all times (except to recover the waste collected) but the collection perimeter is very small (a few meters). It is necessary to multiply the equipment for treating large areas. In addition, the power consumption required to power all the pumps to suck the waste continuously then becomes considerable.

Robotic solutions can include wire-guided waste collection modules. This type of module allows the recovery of waste located in port corners, which can be hard to reach and between parked boats. These can include an aquatic drone that collects floating waste in aquatic areas. Current solutions based on wire-guided devices make it possible to collect wastes remotely but remain difficult to implement in congested and/or remote areas because of the permanent link between the machine and the operator. In addition, each machine requires an operator to control the movements. The cost of using these devices remains high, which makes it difficult to envisage the collection of waste in large areas.

Another robot accumulates the waste between its two hulls but once returned to the base, the accumulated waste is dumped in one place. Then the waste must be picked up again. In addition, in the event of reverse movement, current or waves, wastes can easily come out of the robot. However, the weight of the robot can be considerable so it is difficult or impossible to put it in the water or take it out by one person. The length of the drone can be 1.56 meters. A robot of this size is difficult to transport and launch. Access to tight spaces (in the corners and between boats) is extremely complicated for such a large robot.

Another robot of 1.2 meters long have a duration of use between two refills limited to 2 hours. Its collection capacity is very limited because the waste collector is an articulated landing net. Waste recovery is done manually by emptying the landing net already attached to the robot.

Manual waste collection is still a widely used solution for cleaning aquatic areas with significant human resources. These operations therefore have a significant cost for communities or port managers, which limits the frequency and completeness of clean-up operations. In addition, this exposes workers to significant health risks in contact with pollutants.

Thus, there is a need for marine apparatus for waste collection that is highly maneuverable, man-portable and has a waste collection system that can be easily accessed by a user and reduces overall cost of operation.

SUMMARY

In accordance with an exemplary embodiment of the disclosure a marine apparatus for collecting waste, can include a vessel frame; at least one float mounted on the vessel frame; a removable frame configured to receive a waste collector; at least one guide mounted on either the vessel frame or the removable frame; and at least one slide mounted on the other of the vessel frame or the removable frame, said at least one slide including a channel closed at one end and open at an opposite end, the open end forming a receiving end for receiving a respective guide.

Additional features and advantages of the invention will be set forth or be apparent from the description that follows. The features and advantages of the invention will be realized and attained by the structures and methods particularly pointed out in the written description and claims hereof as well as the appended drawings. It is to be understood that both the foregoing general description and the following detailed description are exemplary and explanatory and are intended to provide further explanation without limiting the scope of the invention as claimed.

DETAILED DESCRIPTION

Figure 1:
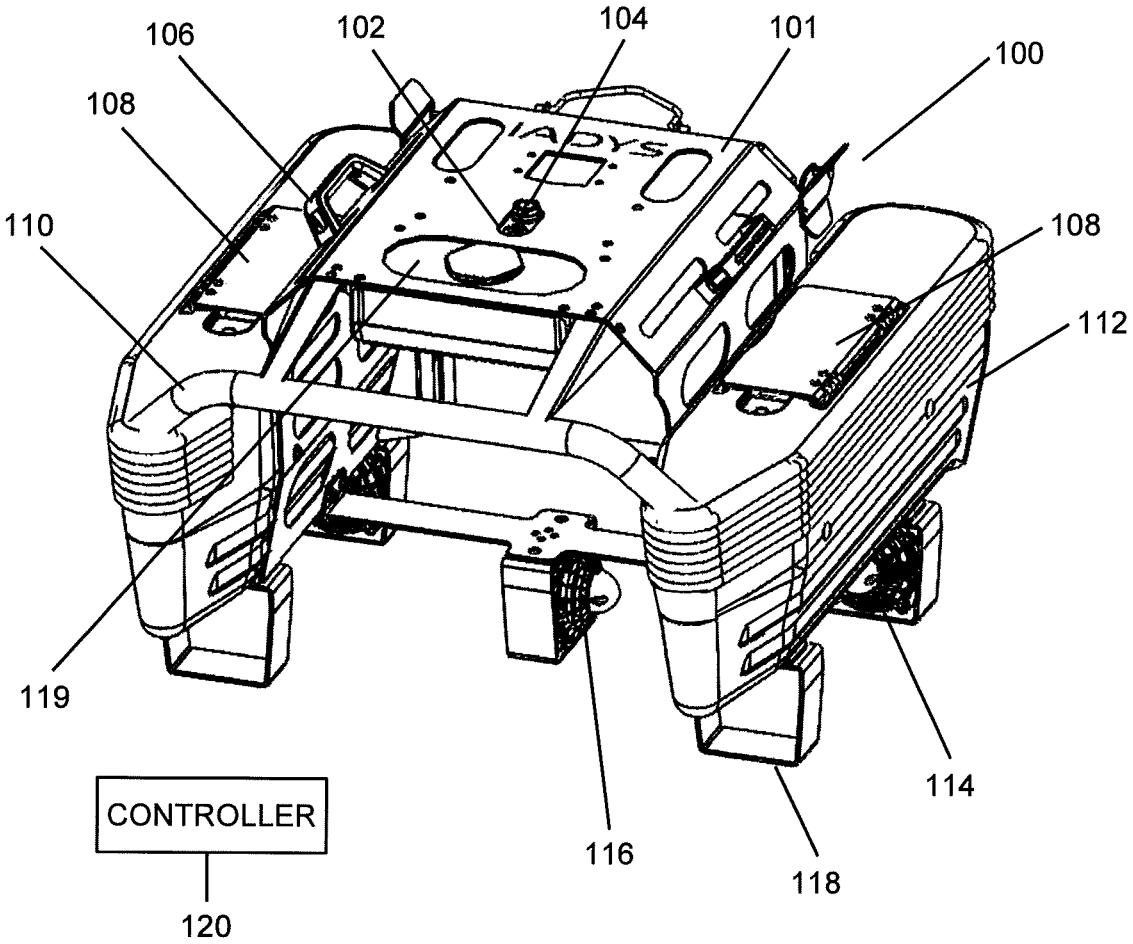
FIG. 1 is a front view of a marine apparatus for collecting waste according to an exemplary embodiment of the disclosure.

Several preferred embodiments of the invention are illustrated in the enclosed Figures in which:

FIG. 1 depicts a marine apparatus 100 according to an exemplary embodiment of the disclosure including a pair of floats 112 for providing buoyancy and a vessel frame 101 arranged between the floats 112. Alternatively, in another embodiment, when the marine apparatus 100 is designed to operate underwater, such a pair of floats 112 can be replaced by a pair of ballast tanks. A protective bar 110 can be provided on the fore section of the floats to act as a bumper for absorbing impacts with other objects. The protective bar 110 can also function as a handle for grasping and maneuvering the marine apparatus 100. Provided on either side of the vessel frame 101 are handles 106 to assist a user with transporting and maneuvering the marine apparatus.

Propulsion of the marine apparatus 100 can be provided by longitudinal motor-driven propellers 114 for providing a forward, reverse and/or rotational movement to the marine apparatus 100. A transverse propeller 116 can be provided for imparting a lateral movement to the marine apparatus 100. The speed of the propellers can be variable so that the marine apparatus can be operated at a variety of speeds.

Arranged in each float is a battery compartment 108 for holding at least one suitably sized battery and electronic materials to provide power for operating the propellers. The battery compartment and/or the battery should be suitable for a marine environment including proper seals. A recharger inlet 104 is provided on the vessel frame 101 so that the batteries can be charged while in place in the battery compartment 108. A start/stop switch 102 is provided on the vessel frame 101 to place the marine apparatus 100 in condition for operation. Each of the longitudinal and transverse propellers can be provided with a guard 118. The guard 118 protects the propellers from underwater objects and also provides a platform for resting the marine apparatus 100 on a firm surface. The propulsion system is not limited and can be any suitable system for powering, propelling and steering the marine apparatus.

According to an exemplary embodiment of the disclosure, the marine apparatus 100 can be operated via a user handheld remote controller 120 emitting, for example, radio frequency control signals, to control the motors that drive the respective propellers via the control command box 119. The marine apparatus can have a suitable antenna for receiving the control signals. According to an exemplary embodiment of the disclosure, the marine apparatus may operate as a robot including a preprogrammed or random route. In another exemplary embodiment according to the disclosure, the controller 120 can be linked to sensors or receivers provided on the marine apparatus which can assess the operational environment and define its own route. The exemplary embodiments of the disclosure can be implemented by at least one processor (e.g., general purpose or application specific) of a computer processing device which is configured to execute a computer program tangibly recorded on a non-transitory computer-recording medium, such as a hard disk drive, flash memory, optical memory or any other type of non-volatile memory. Upon executing the program, the at least one processor is configured to perform the operative functions of the exemplary embodiments by controlling the individual motors of the respective propellers.

Figure 2:
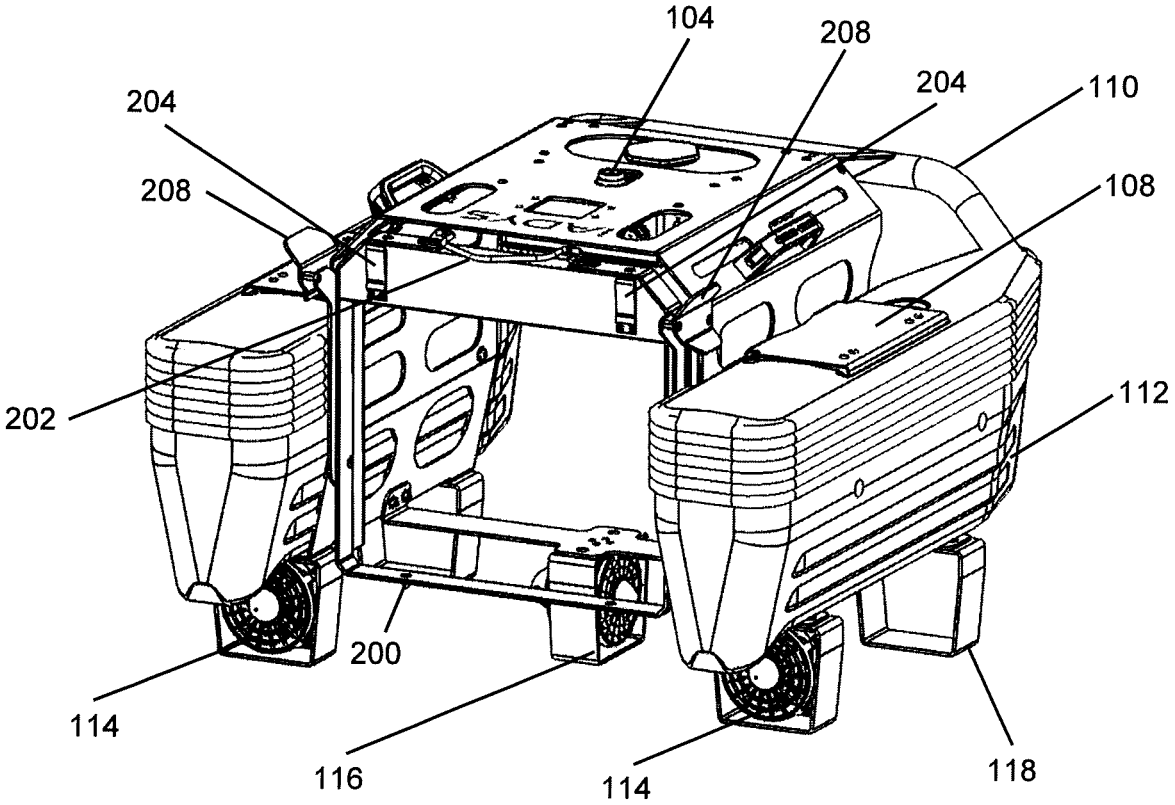
FIG. 2 is a rear view of a marine apparatus for collecting waste according to an exemplary embodiment of the disclosure.

FIG. 2 is an aft view of the marine apparatus according to an exemplary embodiment of the disclosure depicting the removable frame 200 which is removably attached to the marine apparatus 100. In FIG. 2, the removable frame 200 is shown without a waste collector which is described in more detail below. The waste collector can be a separate component and is attachable to the removable frame 200 either by pins 404, 406, shown in FIG. 4, or via attachment clips 204. The removable frame 200 supports the waste collector as the marine apparatus 100 is propelled forward via the propulsion system. The forward motion of marine apparatus 100 and the open front portion allow waste to be collected by the waste collector.

Figure 4:
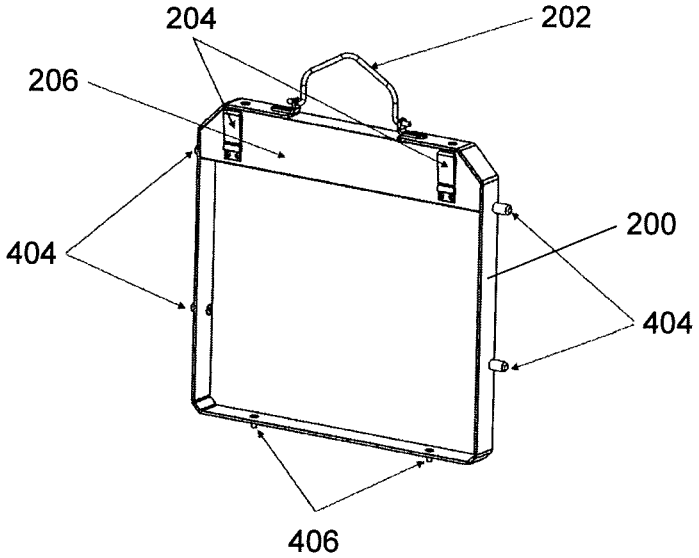
FIG. 4 is a view of a removable frame according to an exemplary embodiment of the disclosure.

As shown in FIG. 4, a float 206 is provided on an upper portion of the removable frame proximate the frame handle 202. The frame handle 202 can pivot and/or rotate. The float 206 provides buoyancy for the removable frame 200 in case the removable frame 200 becomes separated from the vessel frame 101 and/or out of the control of the user. By providing the float 206 proximate the handle 202, it is ensured that the handle 202 is at or near the water surface. The frame handle 202 is provided to allow a user to grasp the removable frame 200 either with a pole having a suitable hook or via a user's hand.

Figure 3A:
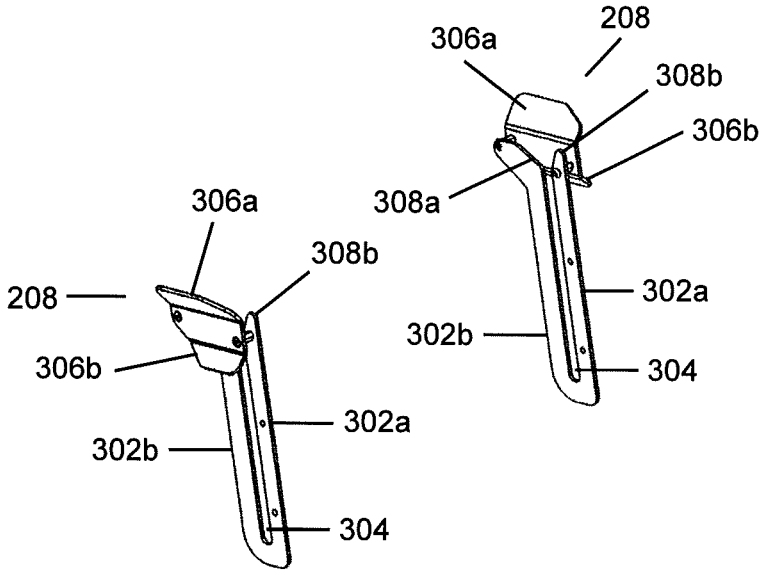
FIG. 3A is a view of longitudinal slides according to an exemplary embodiment of the disclosure.

FIG. 3A is an exemplary embodiment of longitudinal slides 208 which may be mounted on either the vessel frame 101 or the removable frame 200. As described below, the configuration of the longitudinal slide 208 allows the removable frame 200 to be easily removed from the marine apparatus 100 without removing the marine apparatus 100 from the water. The waste collector can then be emptied or replaced and the emptied waste collector or a new waste collector including the removable frame 200 can be easily reattached to the vessel frame 101 for continued use.

The longitudinal slides 208 are formed by first and second arms 302*a*, 302*b* which are substantially parallel (i.e. within ±15°). A channel 304 is formed between the arms 302*a*, 302*b*. The arms 302*a*, 302*b* are contiguous at a closed end and at an opposite end form an open end open to the channel 304. The longitudinal slides 208 can be provided in pairs and are spaced apart on the vessel frame 101 at a distance to accommodate the removable frame 200. By providing the longitudinal slides 208 as separate entities with no direct links, the effect of water drag on movement of the marine apparatus 100 can be limited. This also allows flexibility in the type of removable frame 200 which may be attached to the longitudinal slides 208. In another exemplary embodiment, the longitudinal slides 208 can be mounted on the removable frame 200. A space between the floats 112 for receiving the removable frame 200 should be sized to accommodate the removable frame 200 as well as the longitudinal slides 208. If the longitudinal slides 208 are mounted on the vessel frame 101, then guide pins 404 are arranged on the removable frame 200. If the longitudinal slides 208 are mounted on the removable frame 200, then the guide pins 404 are mounted on the vessel frame 101.

The longitudinal slides 208 each include a first guide surface 306*a* and a second and third guide surfaces 308*a* and 308*b* arranged to guide pins 404 mounted on either of the vessel frame 101 or the removable frame 200, into the channel 304 arranged between the first arm 302*a* and second arm 302*b*. The first guide surface 306*a* and the second and third guide surfaces 308*a* and 308*b* are inclined towards the respective open ends formed by the arms 302*a*, 302*b* of the longitudinal slides 208. The second guide surface 308*a* is formed on the second arm 302*b*. The first guide surface 306*a* can be attached to the longitudinal slide by any suitable method, for example, riveting or welding.

The first guide surface 306*a* arranged on a longitudinal slide 208 on one side of the vessel frame 101/removable frame 200 is inclined inwardly toward a respective channel 304 and toward a longitudinal slide 208 on an opposite side of the vessel frame 101/removable frame 200. A fourth guide surface 306*b* provided on the longitudinal slides 208 is inclined toward the respective open ends and is arranged to easily guide pins 404 out of the channel 304 when the removable frame 200 is extracted.

Figure 3B:
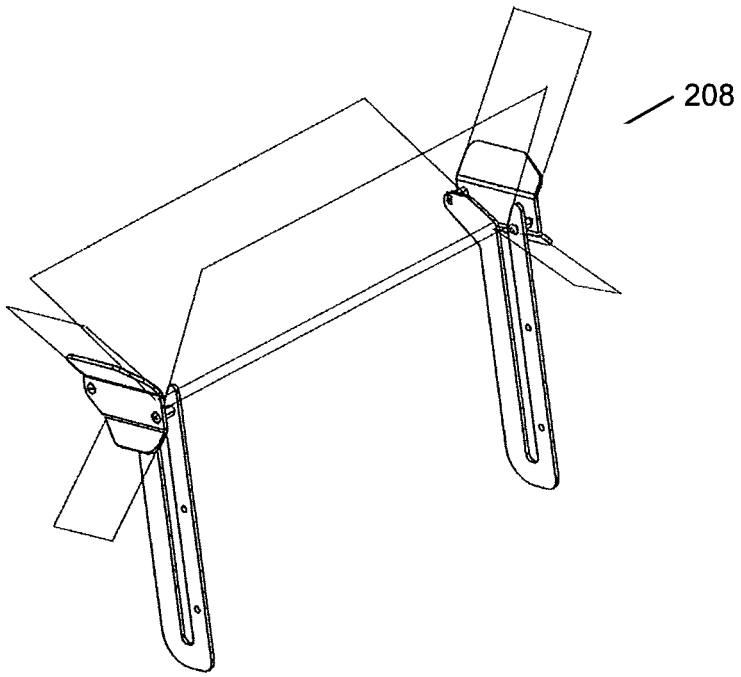
FIG. 3B is a view of the longitudinal slides of FIG. 3A showing inclination planes of surfaces of the longitudinal slides according to an exemplary embodiment of the disclosure.

As shown in FIG. 3B, the first guide surfaces 306*a*, the second and third guide surfaces 308*a* and 308*b* and the fourth guide surfaces 306*b* provide a two-way funnel system which provides a relatively easy method for inserting and extracting the removable frame 200 via the guide pins 404. The arrangement requires relatively little precision and the removable frame 200 does not necessarily have to be vertical for its positioning and its implementation. The removable frame 200 simply drops into the channel 304 by gravity and can stay in place until pulled up by a user.

Figure 5A:
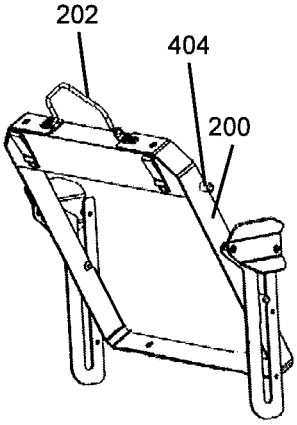
FIGS. 5A-5C are views of the removable frame of FIG. 4 in use according to an exemplary embodiment of the disclosure.
Figure 5B:
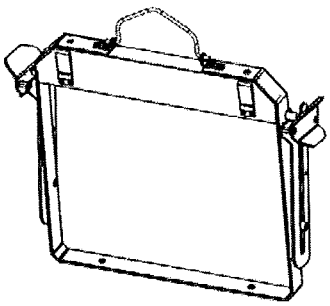
Figure 5C:
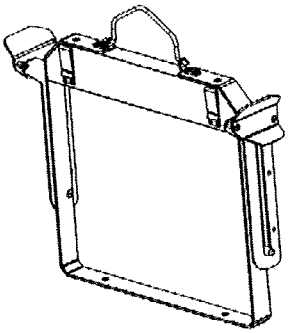

As shown in FIGS. 5A-5C, the user positions the removable frame 200 so that the guide pins 404 contact the first guide surfaces 306*a* and/or second and third guide surfaces 308*a* and 308*b* which, due to their inclination, direct the guide pins 404 into the channel 304. The length of the first arm 302*a* can be greater than a length of the portion of the second arm 302*b* forming the channel, thereby providing a stop when the guide pins 404 are directed into the channel. In an exemplary embodiment according to the disclosure, a single guide pin can be used but otherwise the number of guide pins is not limited. In an exemplary embodiment according to the disclosure, the length of the first arm 302*a* and the second arm 302*b* can be substantially equal (within ±10%).

Figure 6:
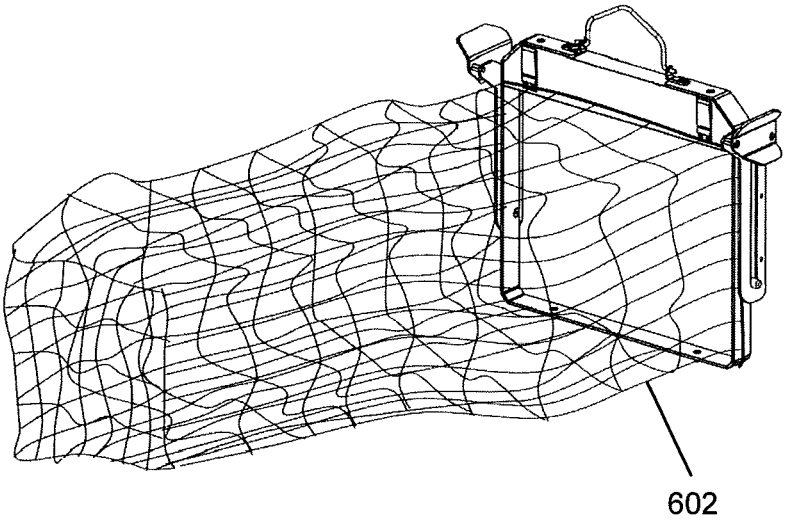
FIG. 6 is a view of the removable frame including a net according to an exemplary embodiment of the disclosure.

In use, the marine apparatus 100 is propelled forward with the forward portion of the removable frame 200 providing an opening for scooping up waste on or near the surface of the water. In an exemplary embodiment of the disclosure shown in FIG. 6, the waste collector can be a net 602 attachable to the frame, for example, by pins provided on the frame including the guide pins 404. In an exemplary embodiment according to the disclosure, the pins can be arranged between the mesh of the net 602. Once the removable frame 200 is attached to the longitudinal slides 208, the net 602 is further secured between the removable frame 200 and the longitudinal slides 208. The waste then is moved to the back of the net 602 by the forward motion of the marine apparatus 100. Once the desired area is clear of waste, or the waste collector is filled to capacity, the marine apparatus 100 can be maneuvered, for example, alongside a pier where it is accessible to a user. A user can then remove the removable frame 200 from the vessel frame, including the waste, either by grasping the handle 202 or by using a pole hooked to the handle 202 to pull the removable frame 200 from the marine apparatus 100.

Figure 7:
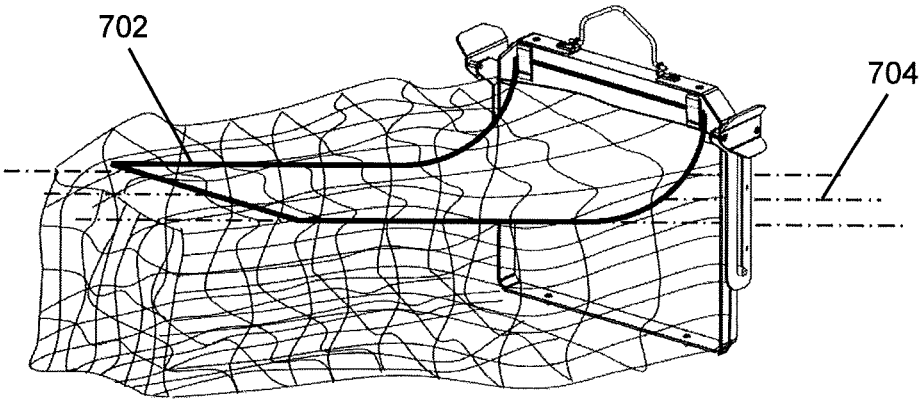
FIG. 7 is a view of the removable frame including a net and an oil-absorbent material according to an exemplary embodiment of the disclosure.
Figure 9:
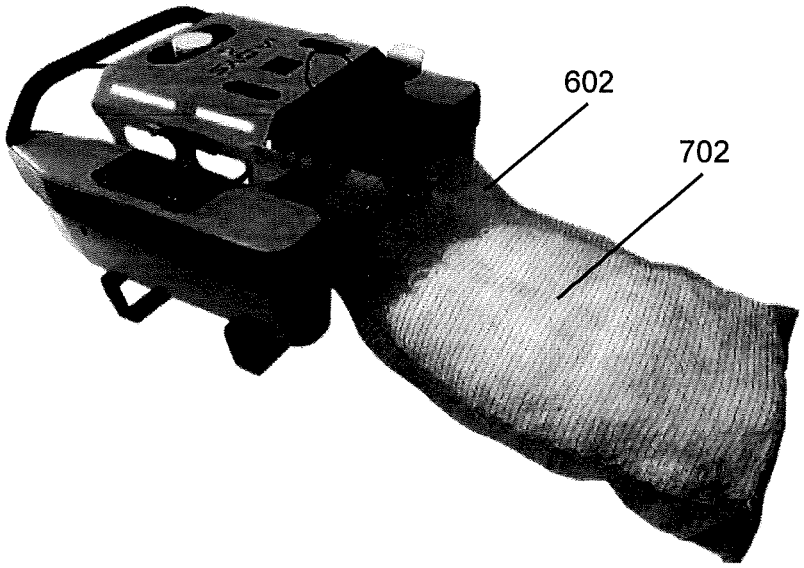
FIG. 9 is a view of the removable frame including a net and an absorbent material according to exemplary embodiments of the disclosure.

As shown in FIG. 7, according to an exemplary embodiment of the disclosure, the waste collector can include an absorbent material 702 such as an oil absorbent material used to absorb hydrocarbons at the water surface 704 and a net 602, allowing also collecting waste. The oil absorbent material can be attached to the removable frame 200 by the attachment clips 204 as shown in FIG. 2. As shown in FIG. 9, according to an exemplary embodiment of the disclosure, the absorbent material 702 can be arranged inside the net 602.

According to an exemplary embodiment of the disclosure, the removable frame can be provided with the guide pins 404 positioned at different heights. For instance, a series of holes can be provided along the side portions of the frame, and the pins can be placed in desired holes to vary the depth at which the frame extends into the longitudinal slides before the lower pins abut the bottom of the channels 304. In this way, the position of the removable frame 200 relative to the water surface can be adjusted depending on the type of waste to be collected.

In various exemplary embodiments according to the disclosure, the length of the removable frame 200 can be made longer or shorter (lengths or widths) to provide different collection capacities dependent upon the circumstances.

Figure 8A:
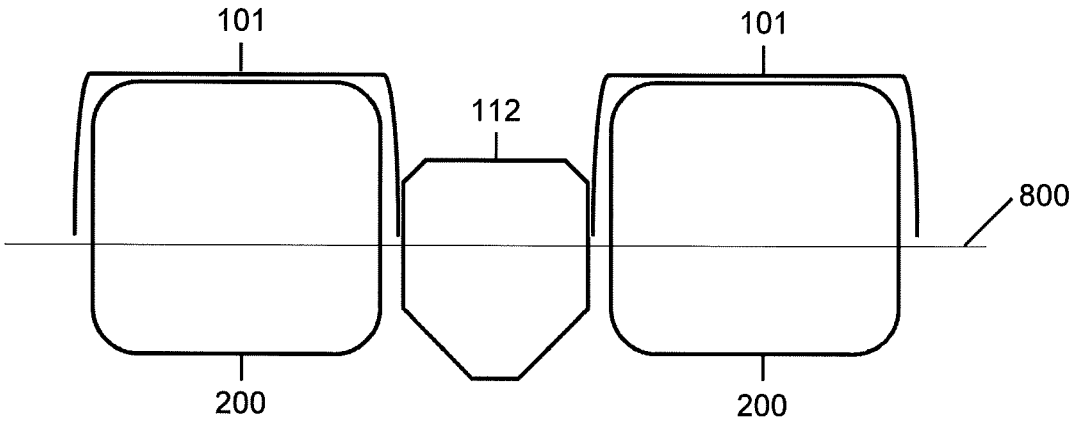
FIGS. 8A-8C depict different arrangements of the marine apparatus according to exemplary embodiments of the disclosure.
Figure 8B:
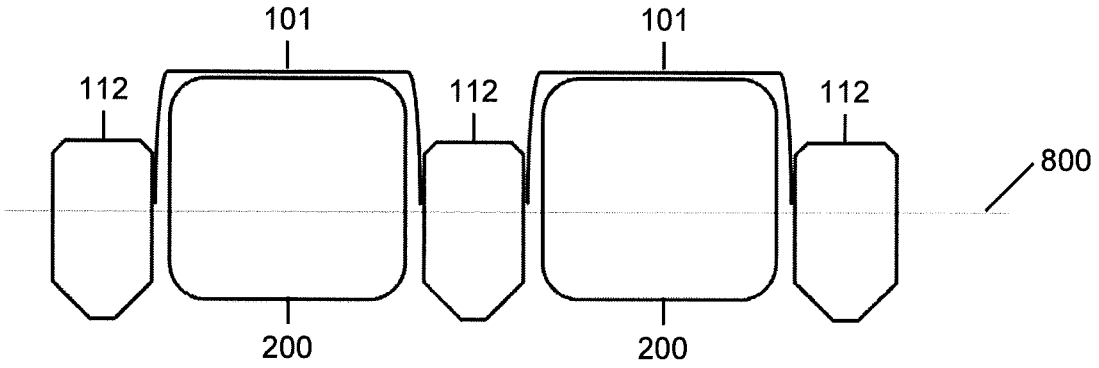
Figure 8C:
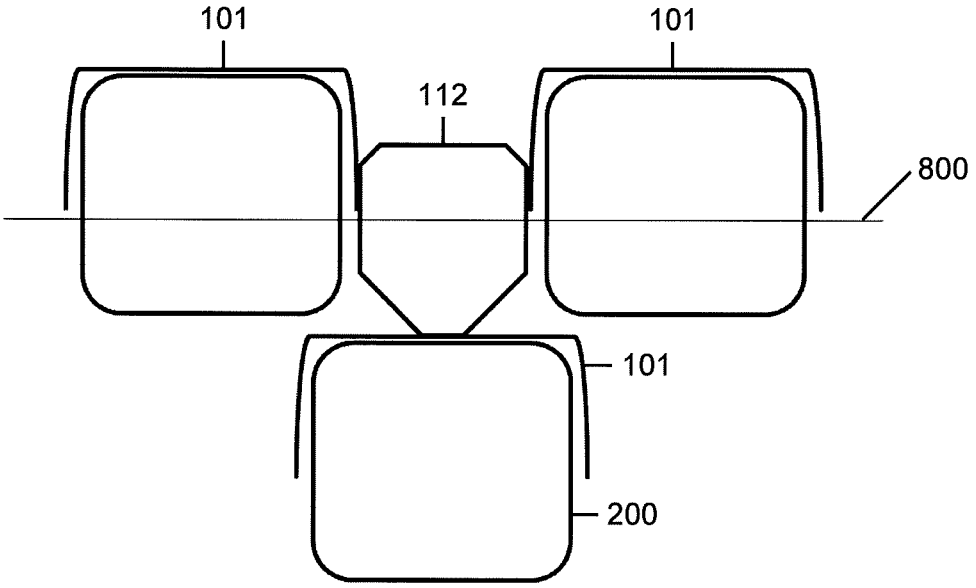

According to exemplary embodiments of the disclosure, the marine apparatus can be arranged in different configurations. As shown in FIG. 8A, one float 112 and two removable frames 200 can be provided, each removable frame 200 being arranged outboard of the float 112. As shown in FIG. 8B, the marine apparatus can be arranged with the three floats 112, and two removable frames 200, wherein the floats 112 are arranged on either side of the removable frames 200. As shown in exemplary embodiment according to the disclosure shown in FIG. 8C, the removable frame 200 can be configured to be arranged entirely below the water line 800 when in use. In an exemplary embodiment according to the disclosure the removable frame 200 can pivot or rotate to enhance access to the user or to change an angle of approach for collecting waste. In the exemplary embodiment shown in FIG. 8C, it may be advantageous to provide ballast tanks and pumps to assist in submerging the removable frame 200 below the water line.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

Although the invention is illustrated and described herein with reference to specific embodiments, the invention is not intended to be limited to the details shown. Rather, various modifications may be made in the details within the scope and range equivalents of the claims and without departing from the invention.

What is claimed is:

1. A marine apparatus for collecting waste, comprising:

a vessel frame;

at least one float or one ballast tank mounted on the vessel frame;

a removable frame configured to receive a waste collector;

at least one guide mounted on either the vessel frame or the removable frame; and at least one slide mounted on the other of the vessel frame or the removable frame, said at least one slide including a channel closed at one end and open at an opposite end, the open end forming a receiving end for receiving a respective guide, wherein the at least one guide comprises:

at least a pair of guide pins mounted on either the vessel frame or the removable frame, the pair of guide pins being arranged to be aligned on a same axis to allow rotation of the removable frame when only the two guide pins are engaged in the slide.

2. The marine apparatus according to claim 1, wherein each receiving end of each at least one slide comprises inclined guide surfaces configured to direct the at least one guide into respective channels.

3. The marine apparatus according to claim 2, wherein the at least one slide includes at least two slides, each comprising first and second arms which are substantially parallel, wherein the channel is formed between the arms, the arms being contiguous at the closed end, wherein the inclined guide surfaces include first guide surfaces formed on the second arm of each of the at least two slides that are arranged to be inclined toward the respective open end of the at least two slides, wherein the first arm is configured to form a stop for a respective guide, and respective second guide surfaces arranged on each of the at least two slides that are each inclined towards each other and towards the respective open ends of the at least two slides.

4. The marine apparatus according to claim 1, comprising:

a propulsion system mounted on the vessel frame, the propulsion system including a power source; and a controller for controlling an operation of the propulsion system for directing a speed and directional movement of the marine apparatus.

5. The marine apparatus according to claim 4, wherein the propulsion system comprises:

at least one propeller configured for imparting a forward, reverse and/or rotational movement to the marine apparatus; and a power source for powering each of the propellers, wherein the speed of each of the propellers is variable.

6. The marine apparatus according to claim 5, wherein the propulsion system further comprises:

at least one propeller configured for imparting a lateral or transversal movement to the marine apparatus.

7. The marine apparatus according to claim 1, wherein the removable frame comprises:

a float provided on the removable frame;

a handle provided on the float; and attachment means configured to attach the waste collector to the frame.

8. The marine apparatus according to claim 7 in combination with the waste collector, wherein the attachment means are clips and the waste collector is an absorbent material.

9. The marine apparatus according to claim 7 in combination with the waste collector, wherein the attachment means are at least one pin and the waste collector is a net.

10. The marine apparatus according to claim 7, wherein the handle is pivotable.

11. The marine apparatus according to claim 1, comprising:

at least one float or one ballast tank; and two removable frames, each removable frame being arranged out board of the at least one float or one ballast tank.

12. The marine apparatus according to claim 1, comprising:

three floats; and two removable frames, wherein the floats are arranged on either side of the removable frames.

13. The marine apparatus according to claim 1, wherein the removable frame is configured to be arranged entirely below the water line in use.

14. The marine apparatus according to claim 1 in combination with the waste collector, wherein the waste collector includes a net and an absorbent material arranged therein.

15. The marine apparatus according to claim 1, wherein the at least one guide comprises:

at least four guide pins mounted on either the vessel frame or the removable frame.

* * * * *